United States Patent [19]

Koga et al.

[11] Patent Number: 4,917,538

[45] Date of Patent: Apr. 17, 1990

[54] TUNNEL LINING PROCESS AND APPARATUS THEREFOR

[76] Inventors: Shigetoshi Koga; Yoshio Hosokawa; Hideo Sueki; Mikio Okano; Ryota Fujiwara, all c/o Fujita Kogyo Kabushiki Kaisha, 6-15, Sendagaya 4-chome, Shibuya-ku, Tokyo; Yukihisa Inagawa, 7-313, Hayashi-cho, Ogaki-shi, Gifu-ken; Ken Fukui, 3-31, Shibata-cho, Minami-ku, Nagoya-shi, Aichi-ken, all of Japan

[21] Appl. No.: 333,583

[22] Filed: Apr. 5, 1989

[30] Foreign Application Priority Data

Apr. 26, 1988 [JP] Japan ..... 63-101349

[51] Int. Cl.[4] ..... E21D 11/00

[52] U.S. Cl. ..... 405/150; 405/146; 405/303

[58] Field of Search ..... 405/146, 150, 268, 303, 405/147; 425/59, 63; 249/9–11; 404/98, 101

[56] References Cited

U.S. PATENT DOCUMENTS

| | | | |
|---|---|---|---|
| 545,978 | 9/1895 | Ransome | 405/150 X |
| 1,478,163 | 12/1923 | Anderson | 405/146 |
| 4,003,211 | 1/1977 | Klapdor et al. | 405/147 X |
| 4,571,119 | 2/1986 | Jones et al. | 404/98 X |
| 4,609,303 | 9/1986 | Shumaker | 404/101 X |
| 4,621,947 | 11/1986 | Babendererde et al. | 405/150 X |

*Primary Examiner*—Dennis L. Taylor

[57] ABSTRACT

A tunnel lining process and an apparatus for use in the process in the prior art are improved in order to greatly enhance a lining speed and to facilitate the work of placing concreate for lining. The improvements reside in that a pressing form for pressing a tunnel concrete lining and a side form to be positioned on the side of the pressing form opposite to an already placed concrete lining are constructed as separate bodies in distinction from the prior art. After the pressing form and the side form have been disposed along an excavated surface of a tunnel, lining concrete is placed in a space delimited by the both forms, the excavated surface and the already placed concrete lining so as to press the lining concrete onto the excavated surface to be lined. Thereafter the pressing form is displaced along the side form and in parallel to the surface to be lined, and the steps of placing lining concrete and displacing the pressing form are repeated until placing of concrete over the entire length of the side form is completed. Then the side form is displaced to the next lining region after the finally placed concrete has revealed its mechanical strength. The aforementioned steps are repeated. A tunnel lining apparatus favorably employed upon practicing the above-described process is also disclosed.

6 Claims, 7 Drawing Sheets

TUNNEL LINING PROCESS AND APPARATUS THEREFOR

BACKGROUND OF THE INVENTION

1. Field of the Invention

The present invention relates to a tunnel press-lining process for placing concrete on a base rock excavated surface in a tunnel construction work or the like and an apparatus for use in the process.

2. Description of the Prior Art

Heretofore, a process for lining a tunnel by means of a press form apparatus in which a pressing form for pressing concrete onto a base rock excavated surface and an expansible side form for blocking the side of the pressing form opposite to an already placed lining concrete are integrally constructed, has been proposed.

However, such type of process and apparatus in the prior art involved the following technical problems to be resolved. In the case of placing lining concrete by means of a press form apparatus in which a pressing form for pressing concrete onto a tunnel lining surface and a side form are integrally constructed, since the forms are removed after the concrete has been solidified, then the forms are shifted in position and concrete is placed and then such operations are repeated, it takes much time for lining. In addition, as a result of the fact that the pressing form and the side form are integrally constructed, expansible form pieces in an expansible side form cannot be designed to be long due to interference with the side portion of the pressing form.

SUMMARY OF THE INVENTION

It is therefore one object of the present invention to provide a novel tunnel lining process in which a lining speed is greatly enhanced as compared to the known process in the prior art, and in which handling of a pressing form and a work of placing lining concrete can be effected easily and quickly.

Another object of the present invention is to provide an improved tunnel lining apparatus which can be favorably employed in the novel tunnel lining process.

Accordingly to one feature of the present invention, there is provided a tunnel lining process consisting of the steps of disposing a pressing form for pressing a tunnel concrete lining and a side form constructed separately from the inner form and positioned on the side of the pressing form opposite to an already placed concrete lining along an excavated surface of a tunnel, placing lining concrete in a space delimited by the both forms, the excavated surface and the already placed concrete lining so as to press the lining concrete onto the excavated surface to be lined, thereafter displacing the pressing form along the side form and in parallel to the surface to be lined, then repeating the steps of placing lining concrete and displacing the pressing form until placing of concrete over the entire length of the side form is completed, displacing the side form to the next lining region after the finally placed concrete has revealed its mechanical strength, and repeating the above-described steps.

According to another feature of the present invention, there is provided a tunnel lining apparatus comprising a rotary form positioning device disposed on a frame of a crawler, a pressing form for pressing lining concrete onto a tunnel surface to be lined, a side form constructed separately from the inner form and positioned on the side of the pressing form opposite to an already placed concrete lining, support beams for the respective forms, and an actuator for swinging the support beam for the pressing form and another actuator for swinging the support beam for the side form both disposed in juxtaposition on the rotary form positioning device.

As described above, according to the present invention, since a pressing form for pressing a tunnel concrete lining and a side form positioned on the side of the pressing form opposite to an already placed concrete lining are constructed separately from each other, after lining concrete has been placed in a space delimited by the pressing form, the side form, the excavated surface and the already placed concrete lining to an extent that can be allowed to be placed in one step, the pressing form can be displaced along the side form and the surface to be lined by a distance corresponding to the concrete lining placed in the preceding step without waiting until the placed lining concrete reveals its mechanical strength, and these steps can be repeated until placing of concrete over the entire length of the side form is completed, when placing of concrete is interrupted until the finally placed concrete reveals its mechanical strength. Thus, there is no need to wait appearance of the mechanical strength of the respective concrete lining portions placed in the respective steps. Therefore, if lengths of the pressing form and the side form are chosen to be sufficiently long as compared to the allowable extent for placing concrete in one step, the lining speed can be greatly enhanced. Also, handling of the inner form and the work of placing lining concrete can be effected easily and quickly.

Furthermore, if the tunnel lining apparatus according to the present invention is employed in the above-featured tunnel lining process, the orientations of the respective forms can be adjusted by rotating and swinging the respective support beams for the respective forms by means of the rotary positioning device on the frame and the pair of actuators for the respective support beams, and also the forms can be displaced while maintaining their attitude opposed to the base rock excavated surface.

The above-mentioned and other objects, features and advantages of the present invention will become more apparent by reference to the following description of one preferred embodiment of the present invention taken in conjunction with the accompanying drawings.

DESCRIPTION OF THE PREFERRED EMBODIMENT

Figure 1:
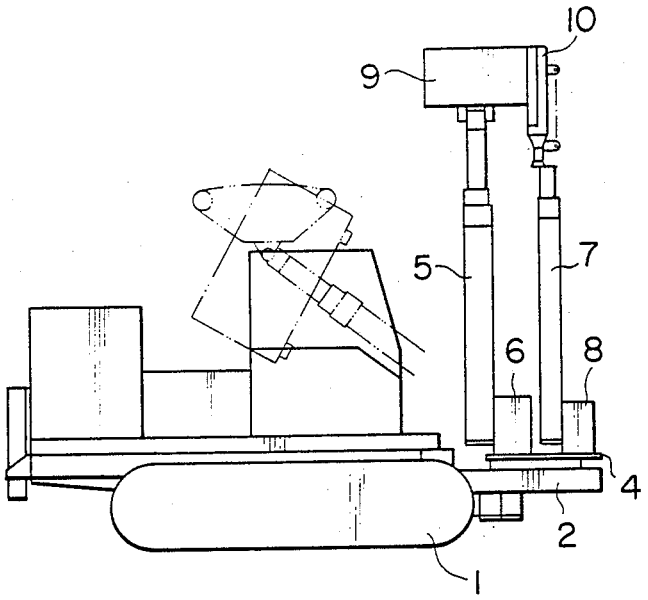
FIG. 1 is a side view showing one preferred embodiment of a tunnel lining apparatus according to the present invention.
Figure 2:
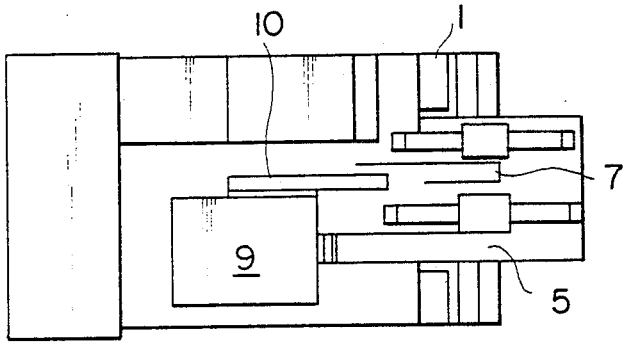
FIG. 2 is a plan view of the same apparatus.
Figure 3:
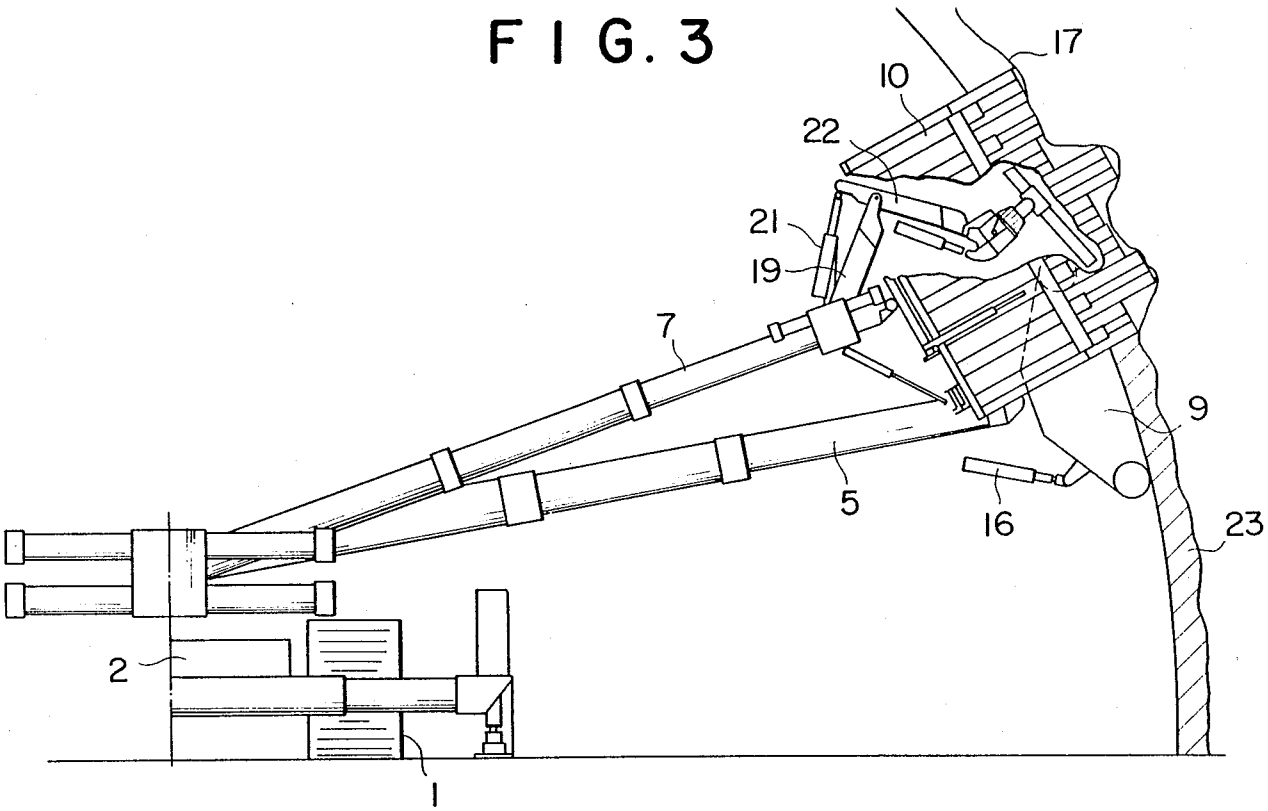
FIG. 3 is a front view showing a working state of the same apparatus.
Figure 4:
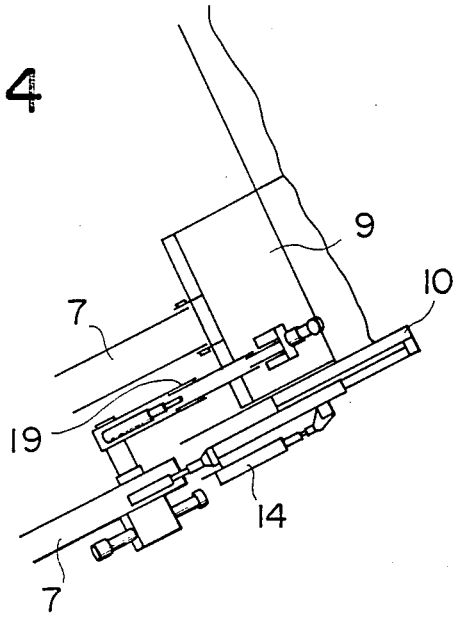
FIG. 4 is a plan view showing the same state.
Figure 5:
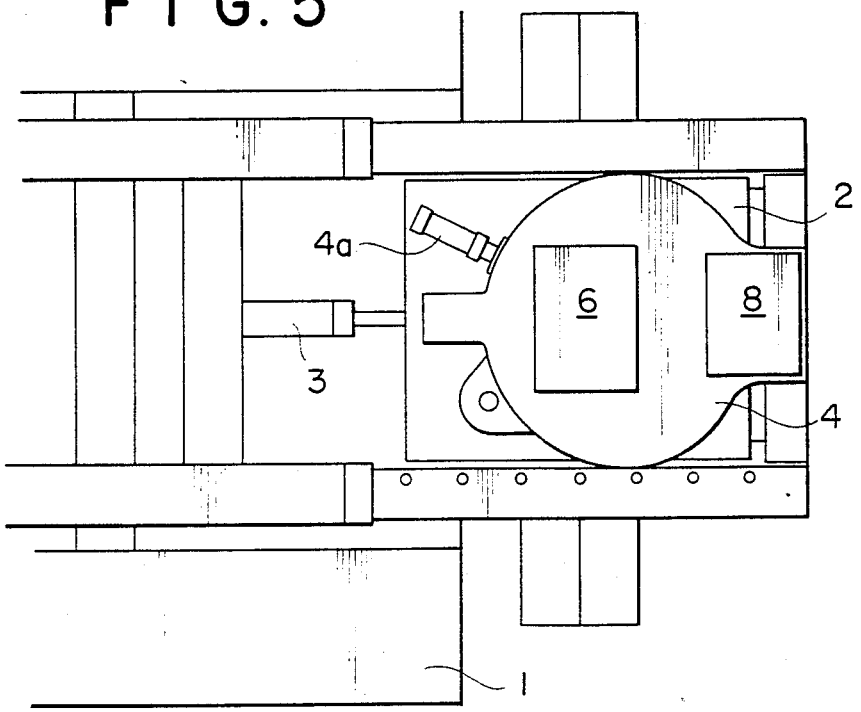
FIG. 5 is a plan view showing a form loading section of a crawler.
Figure 6:
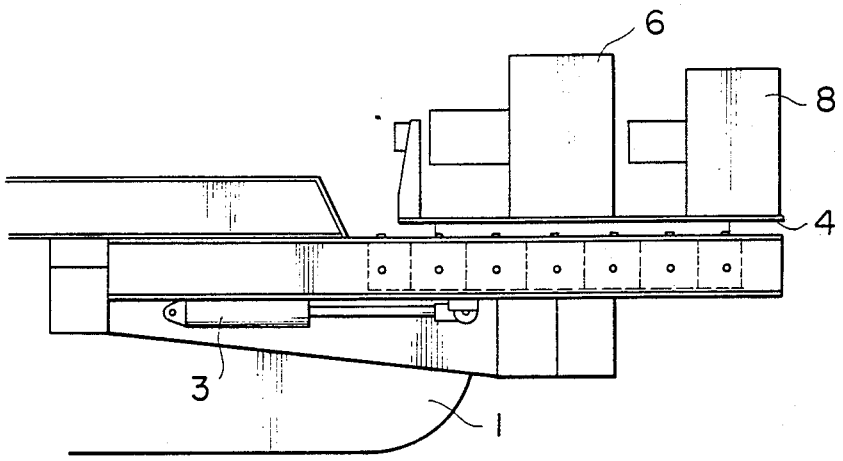
FIG. 6 is a side view of the same.

Now the present invention will be described in greater detail in connection to the illustrated embodiment. Reference numeral (1) designates a crawler, numeral (2) designates a frame, numeral (3) designates a hydraulic jack for sliding the frame, numeral (4) designates a rotary device disposed on the frame, and numeral (4*a*) designates a rotary braking device.

On the above-mentioned rotary device (4) are disposed in juxtaposition a swinging actuator (6) for a tunnel lining concrete pressing form support beam (5) and another swinging actuator (8) for a support beam (7) of a side form for blocking an open side of the pressing form on the opposite side to an existing concrete lining.

The respective support beams (5) and (7) are constructed in an expansible and contractible manner by means of a known mechanism, and at their tip ends are supported a tunnel lining concrete pressing form (9) and a side form (10), respectively.

It is to be noted that in the above-described side frame (10), side frame pieces (12) are adapted to be elevated and lowered by means of hydraulic jacks (11) contained in the side frame main body, between the main body of the side frame (10) and the side frame support arm (7) are connected lateral displacement arms (13) via pins, and the arrangement is such that the side frame (10) can be displaced laterally by retracting a hydraulic jack (14) for connecting the side frame main body (10) with the support arm (7). In the drawings, reference numeral (15) designates slots for moving the side form pieces (12) provided in the main body of the side form main body. In addition, reference numeral (16) designates an inclination angle correcting jack for the lining concrete pressing frame (9).

Since the illustrated embodiment is constructed in the above-described manner, in operation the respective forms (9) and (10) are disposed in parallel to a tunnel surface (17) to be lined by driving the rotary device (2), then the respective forms (9) and (10) are set on a ground line of the surface to be lined by driving the above-described actuators (6) and (8), and a radius of a lining work is determined by adjustably extending or contracting the support beam (5). In addition, the pressing form (9) is turned by about 180° along a lining locus to check whether a contact portion between the pressing surface of the pressing form (9) and the excavated uneven surface of the ground is present or not, and then the pressing form (9) is returned to the original position and set there.

On the other hand, the side form (10) is disposed on the side surface of the pressing form (9) on the opposite side to an already placed lining concrete in parallel to the lengthwise direction of the pressing form (9) by means of the support beam (7), the side form pieces (12) are extended or contracted so as to butt against the excavated uneven surface in a conformed manner, and thereby the open side surface of the pressing form (9) on the opposite side to the already placed lining concrete is closed.

The lengths of the pressing form (9) and the side form (10) in the movable direction of the forms are chosen to be at least three times the allowable extent of placing concrete in one step. In the illustrated embodiment, the lengths of the forms (9) and (10) are three times as long as the allowable extent of placing concrete in one step. Upon placing lining concrete, concrete is injected from a concrete nozzle (22) supported by the side form support beam (7).

Figure 10:
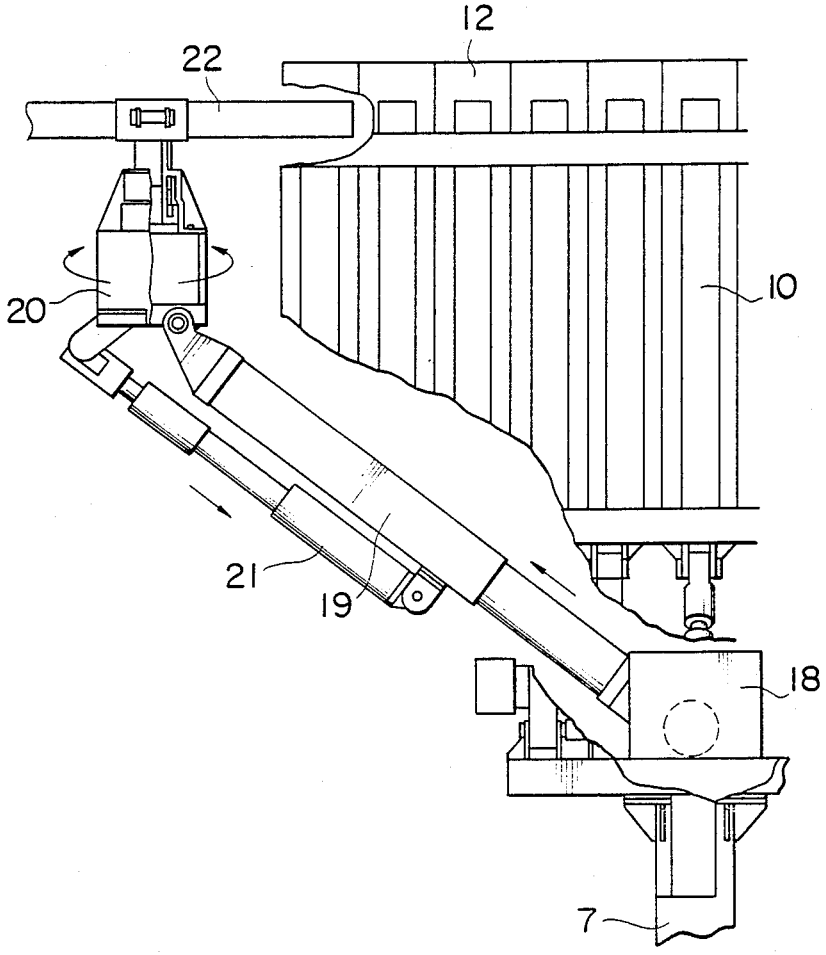
FIG. 10 is a front view of a concrete placing nozzle section.

A detailed structure of the concrete nozzle arrangement is shown in FIG. 10. A spinning actuator (20) is pivotably supported at a tip end of a nozzle extensible/-contractible boom (19) which is in turn rotationally driven by a nozzle revolving actuator (18) supported from the side form support beam (7), an angle adjusting hydraulic jack (21) is interposed between the aforementioned spinning actuator (20) and the nozzle extensible/-contractible boom (19), and thereby it is made possible to place concrete in a space delimited by the above-described forms (9) and (10) and the already placed lining concrete (23).

Figure 11:
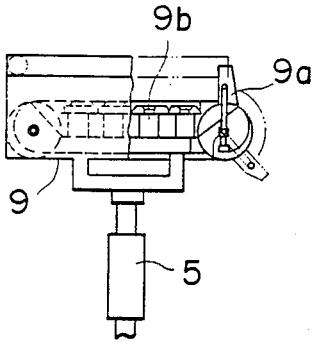
FIG. 11 is a side view partly cut away showing an operating state of a concrete passing device in a lining concrete pressing form.
Figure 12:
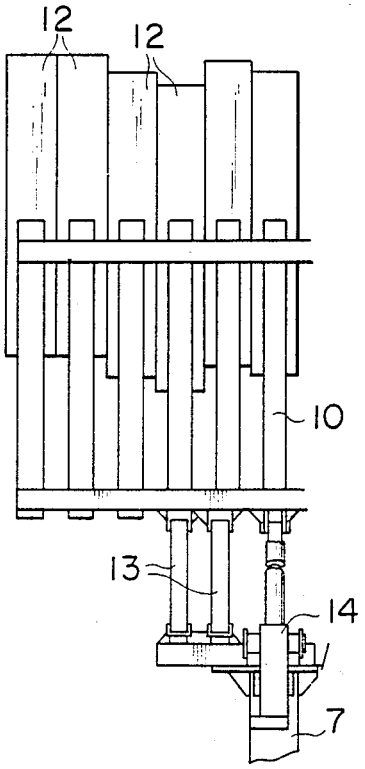
FIG. 12 is a front view of a side form.

When the placing of concrete has been completed, the concrete is pushed into the space within the pressing form (9) by rotating an end form (9*a*) contained within the pressing form (9), and thereafter the concrete is pressed against the excavated surface by means of a pressing device (9*b*) contained within the pressing form (9) as shown in FIG. 11. The device shown in FIG. 11 is explained in greater detail in the specifications of Japanese Utility Model Application No. 61-119444 (1986) relating to a prior invention invented by the inventors of this invention.

After the above-described pressing work has been finished, immediately the pressing form (9) is displaced by a distance equal to one-third of the length of the side form (10) by swinging the support beam (5) by means of the actuator (6), and then concrete is placed again by opening the end form (9*a*).

By repeating the above-mentioned steps of operation three times, concrete lining over the entire length (L) of the side form (10) is completed.

If the entire tunnel excavated surface is lined by concrete by repeating the aforementioned operations, the concrete lining speed can be remarkably promoted as compared to the known concrete lining process in which each time concrete is placed, after waiting solidification of the placed concrete the form is displaced once.

Figure 7:
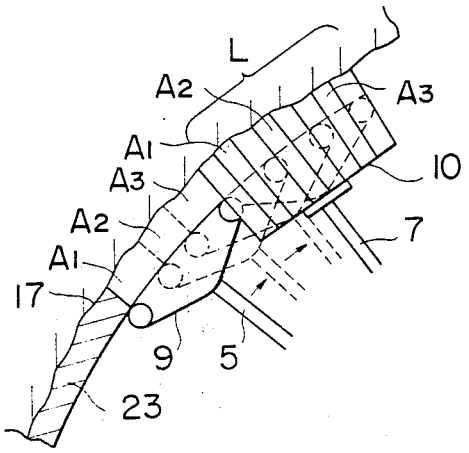
FIG. 7 is a front view showing the state of forms upon placing concrete.

With regard to the speed-up of the tunnel lining process, description will be made in greater detail with reference to FIG. 7.

After concrete has been placed in a space delimited by the both forms (9) and (10) and the already placed concrete (23) and the placed concrete has hardened, the side form (10) is displaced by a distance equal to its length (L) by operating the actuator (8), subsequently the pressing form (9) is displaced by a distance equal to one-third of the pressing form (9) by operating the actuator (6), and concrete is place in the space delimited by the forms (9) and (10) at the position indicated by ($A_1$) and pressed against the excavated surface.

When the placing of concrete at this position ($A_1$) has been completed, without waiting solidification of the placed concrete the pressing form (9) is displaced by a distance equal to one-third of the pressing form (9), and concrete is placed at the position indicated by ($A_2$) and pressed against the excavated surface.

When the above-described steps of operation have been repeated three times and finally concrete has been placed at the position indicated by ($A_3$), that is, concrete has been placed over the entire length (L) of the side form (10), after waiting solidification of the finally placed concrete at the position ($A_3$), concrete lining over the entire length (L) is completed.

By repeating the above-described operation, an excavated surface of a tunnel can be successively lined by concrete.

According to the process of the above-described embodiment, since the pressing form can be displaced under an unsolidified condition of concrete, a lining speed can be enhanced as compared to the process in the prior art in which each time concrete is placed, the pressing form is displaced after the placed concrete has been solidified.

Assuming now that a solidification time of concrete is 3 minutes and a concrete placing time in one step is one minute, and comparing a concrete lining speed between the process in the prior art in which each time concrete is placed a pressing form and a side form are displaced after solidification of the placed concrete and the process according to the present invention in which after concrete has been placed three times while a pressing form is successively displaced a side form is displaced once:

the necessary concrete lining time according to the prior art process would amount to 3 minutes (one location)+3 minutes (one location)+3 minutes (one location)=9 minutes;

the necessary concrete lining time according to the present invention would amount to 1 minute (one location)+1 minute (one location)+3 minutes (one location)=5 minutes; and therefore, according to the present invention, a concrete lining speed can be greatly improved.

Figure 8:
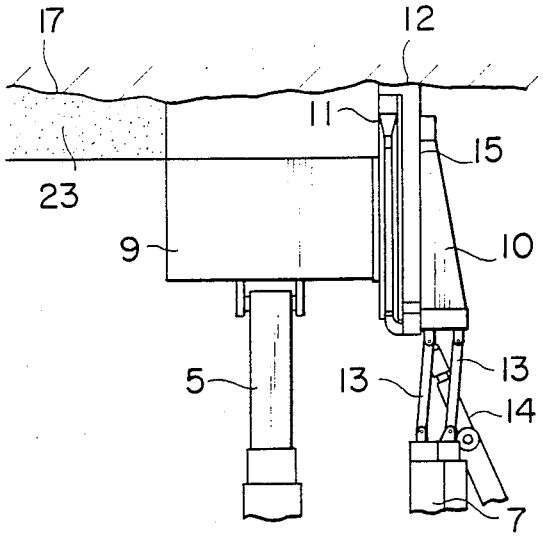
FIGS. 8 and 9 are side views showing working states in the case where supports are not present and in the case where supports are present, respectively.
Figure 9:
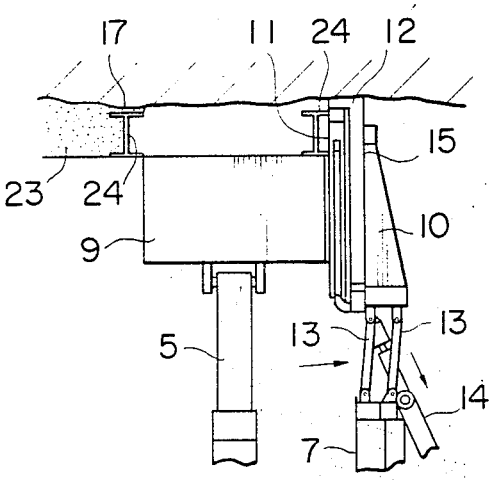

It is to be noted that while FIG. 8 illustrates the case where supports are not used, in the case of employing supports (24) as show in FIG. 9, the side form (10) is displaced in the lateral direction by retracting the above-described hydraulic jack (15), and it is positioned outside of the support (24).

As described in detail above, according to the tunnel lining process of the present invention, by separately constructing a pressing form for pressing a tunnel concrete lining and a side form to be positioned on the side of the pressing form opposite to an already placed concrete lining from each other, the side form and the pressing form can be displaced individually, and as a result, a lining speed can be greatly enhanced.

In addition, the tunnel lining apparatus according to the present invention can improve a lining speed and can perform the works of disposing forms and placing concrete easily and quickly, by rotationally driving the support beams of the tunnel lining surface pressing form and the side form constructed separately from each other as described above, by means of the actuator for swinging the support beam of the pressing form and the actuator for swinging the support beam of the side form disposed in juxtaposition on a rotary form positioning device which is arranged on a frame of a crawler.

While a principle of the present invention has been described above in connection to one preferred embodiment of the invention, it is a matter of course that many apparently widely different embodiments of the invention can be made without departing from the spirit of the present invention.

What is claimed is:

1. A tunnel lining process consisting of the steps of disposing a pressing form for pressing a tunnel concrete lining and a side form constructed separately from said pressing form and positioned on the side of said pressing form opposite to an already placed concrete lining along an excavated surface of a tunnel, placing lining concrete in a space delimited by said both forms, the excavated surface and the already placed concrete lining so as to press the lining concrete onto the excavated surface to be lined, thereafter displacing said pressing form along said side form and in parallel to said surface to be lined, then replacing the steps of placing lining concrete and displacing said pressing form until placing of concrete over the entire length of the side form is completed, displacing said side form to the next lining region after the finally placed concrete has revealed its mechanical strength, and repeating the above-described steps.

2. A tunnel lining process as claimed in claim 1, wherein the distance over which said pressing form is displaced in one step is determined by the allowable extent for placing concrete in one step, and the length of said side form is equal to a multiple of said distance.

3. A tunnel lining process as claimed in claim 1, wherein said pressing form is displaced in one step by a distance equal to one-third of the length of said side form.

4. A tunnel lining apparatus comprising a rotary form positioning device disposed on a frame of a crawler, a pressing form for pressing concrete onto a tunnel surface to be lined, a side form constructed separately from said inner form and positioned on the side of said inner form opposite to an already placed concrete lining, support beams for said respective forms, and an actuator for swinging the support beam for said pressing form and another actuator for swinging the support beam for said side form both disposed in juxtaposition on said rotary form positioning device.

5. A tunnel lining apparatus as claimed in claim 4, wherein the length of said side form is equal to a multiple of a length of a concrete lining portion that can be placed in one step.

6. A tunnel lining apparatus as claimed in claim 4, wherein the length of said side form is equal to three times a length of a concrete lining portion that can be placed in one step.

* * * * *